US008307748B2

(12) United States Patent
Saucedo

(10) Patent No.: US 8,307,748 B2
(45) Date of Patent: Nov. 13, 2012

(54) MULTI-RANGE CAMOUFLAGE DESIGN AND METHOD

(75) Inventor: Kent D. Saucedo, Mesa, AZ (US)

(73) Assignee: Armorworks Enterprises LLC, Chandler, AZ (US)

( * ) Notice: Subject to any disclaimer, the term of this patent is extended or adjusted under 35 U.S.C. 154(b) by 0 days.

(21) Appl. No.: 13/108,765

(22) Filed: May 16, 2011

(65) Prior Publication Data

US 2012/0132063 A1 May 31, 2012

Related U.S. Application Data

(60) Provisional application No. 61/345,033, filed on May 14, 2010.

(51) Int. Cl.
*G06T 5/50* (2006.01)

(52) U.S. Cl. ..... 89/36.01; 382/284; 345/435; 345/582

(58) Field of Classification Search ..... 89/36.01; 345/627; 382/298
See application file for complete search history.

(56) References Cited

U.S. PATENT DOCUMENTS 6,137,498 A * 10/2000 Silvers ..... 345/629
6,532,312 B1 * 3/2003 Corkran ..... 382/284
6,549,679 B1 * 4/2003 Zheng ..... 382/284
6,665,451 B1 * 12/2003 Kusama et al. ..... 382/282
6,805,957 B1 10/2004 Santos
6,895,127 B1 * 5/2005 Zheng ..... 382/294
7,565,028 B2 * 7/2009 Saed ..... 382/284
7,809,732 B2 * 10/2010 Kusama et al. ..... 707/749
2003/0001858 A1 * 1/2003 Jack ..... 345/582
2004/0209051 A1 10/2004 Santos
2005/0147322 A1 * 7/2005 Saed ..... 382/284
2009/0154777 A1 6/2009 Cincotti et al.
2009/0252913 A1 10/2009 Cincotti et al.
2009/0313740 A1 12/2009 Santos
2010/0031423 A1 2/2010 Cincotti et al.
2010/0112316 A1 5/2010 Cincotti et al.
2010/0288116 A1 11/2010 Cincotti et al.

* cited by examiner

*Primary Examiner* — Michael Carone
*Assistant Examiner* — John D Cooper
(74) *Attorney, Agent, or Firm* — James L. Farmer

(57) ABSTRACT

Designs and methods are provided for a multi-range camouflage. In one exemplary embodiment, the camouflage comprises an array of tiles creating a micro camouflage pattern discernable at a first distance. The camouflage design further comprises a macro camouflage pattern discernable at a second distance that is substantially greater than the first distance. The macro camouflage pattern is inherent in the arrangement of tiles forming the micro camouflage pattern, and based on a predefined source image.

17 Claims, 5 Drawing Sheets

MULTI-RANGE CAMOUFLAGE DESIGN AND METHOD

TECHNICAL FIELD AND BACKGROUND

The present invention generally relates to camouflage designs and patterns for concealment of persons or objects in various surroundings.

DESCRIPTION OF THE EMBODIMENTS

Figure 1:
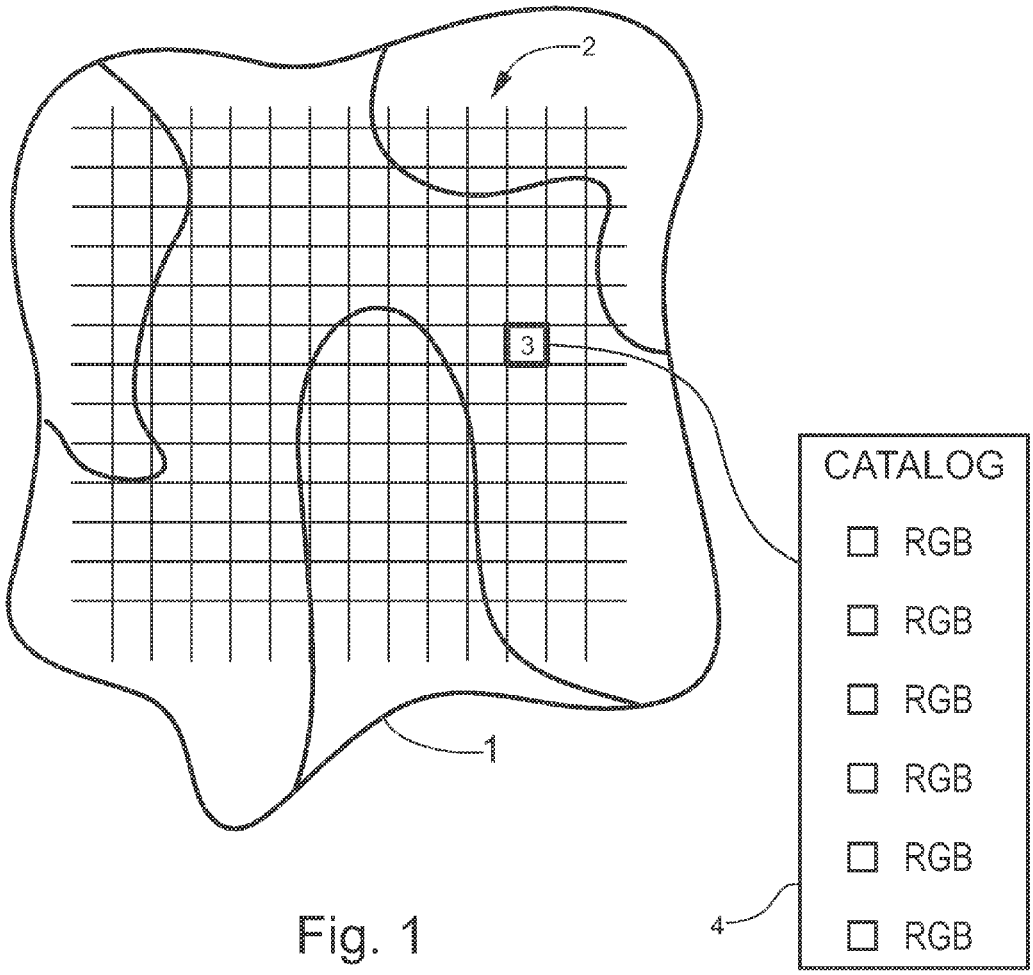
FIG. 1 is a schematic representation of a portion of an arbitrary source image overlaid with a grid of square cells.

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list. Terms such as "connected" or "attached" as used herein are intended to denote direct, indirect (with intermediate elements), rigid, and flexible linking arrangements, as well as linking arrangements with one or more degrees of freedom.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

In one embodiment an exemplary multi-range camouflage comprises an array of visual elements or images that together define a first, micro appearance or pattern when viewed at close range, and a second, macro appearance or pattern when viewed from long range. The macro pattern is inherent in the micro pattern, and may be a larger version of the micro pattern, or a different pattern completely.

The meaning of close range and long range with respect to the micro and macro patterns is generally dependent upon the particular application, and the anticipated range of distances over which a camouflage effect is desired. For example, it may be desirable for a soldier's camouflage to provide effective concealment at distances in the range of 30 feet to 300 feet. On the other hand, large vehicles such as tanks or troop carriers may benefit from concealment over much larger distances, such as over a range of several hundred to several thousand feet.

A multi-range camouflage of the present invention may be configured such that the distance associated with the micro camouflage pattern corresponds generally to the low end of the desired concealment range, and the distance associated with the macro camouflage pattern corresponds generally to the high end of the desired concealment range. Taking for example the previously mentioned soldier with a desired concealment range of 30 feet to 300 feet, an optimal distance associated with the micro camouflage pattern may be 60 feet, and the optimal distance associated with the macro camouflage pattern may be 250 feet.

Further, the micro and macro patterns will each generally be useful or effective over a discreet distance range, and the ranges may or may not overlap. Continuing with the soldier example, the micro camouflage pattern may have an effective range of 30 to 90 feet, while an embedded macro pattern is effective when viewed from 200 to 300 feet away. In this case the mean or average effective ranges are 60 feet for the micro pattern and 250 feet for macro pattern, and the effective ranges do not overlap. It should also be noted that references herein to ranges or distances associated with a camouflage pattern, unless otherwise specifically noted, should not necessarily be interpreted as defining an exact distance.

In one exemplary multi-range camouflage the macro camouflage pattern is obtained from a preferential arrangement of the visual elements or images (for convenience referred to herein as "tiles") within the array. Some or all of the tiles in the array may vary from one another in color, brightness, size, or pattern. Each tile effectively becomes one pixel or cell of the macro pattern, similar in that respect to a so-called photographic mosaic. In the field of photographic imaging, a photographic mosaic (also "photomosaic") is a picture, such as a photograph or painting, in which each pixel of the picture is replaced by another much smaller image or photograph with similar coloration and appearance to the pixel being replaced. When viewed at low magnifications, the original picture, or primary image appears, while close examination reveals that the primary image is in fact made up of many hundreds or thousands of smaller images. Typically photomosaics are a computer-created type of montage.

The long range, macro pattern of a multi-range camouflage is based on a pre-defined or pre-selected source image that is divided into an array of small sections, or cells. The cells may, for example, be regular or irregular geometric shapes, such as rectangles, triangles, hexagons, or various combinations thereof. Each cell of the source image array is replaced by a tile selected on the basis of color, and various color restrictions. The tiles are selected and arranged to produce a first, micro camouflage pattern that dominates the appearance at close range, and a second, macro camouflage pattern that resembles the source image and dominates the appearance when viewed from a long range distance.

The source image may be any new or existing design, pattern, drawing, or image, or any combination thereof. For example, the source image may comprise a known military camouflage pattern, a photographic image, a computer generated image, or a computer altered photograph, among other things. The source image may be selected or configured to be particularly effective over a defined distance range, and in a specific environment or region. In one embodiment, information such as geographic location or type of terrain is used to create a computer generated source image comprising an arrangement of lines or other shapes of appropriate scale and orientation. A desired source image may be scanned if necessary, or otherwise saved in digital form on a computer readable memory or storage device.

As noted, the camouflage comprises an array of cells of pre-defined size, shape, and arrangement. Various factors may influence the cell design and arrangement. For example reducing the cell size tends to improve the overall clarity and definition of the long range macro pattern. However in one exemplary embodiment the micro pattern is intended to be effective at substantially shorter ranges where the individual cells are discernable and dominate the overall appearance of the camouflage. In that respect the needs of the micro pattern may create a practical limit to the minimum tile size. Thus choice of cell size may involve to some extent a balance between the needs of the macro and micro patterns.

The anticipated use of the camouflage may also factor into the definition of the cell grid. For example, the appearance of a certain type of landscape or environment may have a noticeable directional quality to it. More specifically, the overall appearance of an arid or desert type landscape tends to be relatively horizontal, while forested or tropical landscapes present more vertical lines. The selection and arrangement of the cell grid may be tailored to help capture such optical features in a macro or micro pattern. In one such embodiment, the grid pattern comprises an arrangement of elongated cells, such that the long direction of the cells generally aligns with the predominant directional quality of the source image. The directional orientation of cells may be consistent and uniform throughout a particular camouflage pattern, or vary from one portion of the pattern to another.

Using the selected cell configuration, the source image is divided into an array of cells, each cell containing a small portion of the source image. This process may be carried out electronically using known techniques or products, such as commercially available mesh generation software. Each cell may then be characterized in terms of color and brightness of the contained portion of the source image. For example, in one embodiment the average RGB (red, green, blue) chromaticity value of the contained image is calculated and stored for each cell.

Each cell of the source image is ultimately replaced by a tile that is selected to create a desired micro and macro camouflage appearance. A tile may be an image, a portion of an image, a single color image, or a color from any new or existing color chart, palate, or catalog. In one embodiment the tiles may are selected from an electronically stored tile catalog containing an assortment of distinct tiles comprising digital photographic images. The digital photographs may be anywhere from several megapixels in size and very detailed, down to one pixel in size with no image detail, or anything in between. The tile catalog may include information stored with each digital photograph, such as the average tile color characterized in terms of its RGB (red, green, blue) chromaticity values.

Information stored with each photograph may additionally include the date, time, and location at which the photograph was taken. The location information may comprise for example the precise GPS coordinates in the form of latitude, longitude, and elevation. The tile catalog may further comprise multiple tile catalogs, each one containing photographs of a particular type or location. For example, the photographs may be organized according to specific country, geographic region, or the type of landscape environment, such as arid, cultivated, forested, tropical, alpine, or urban environments. Various other tile organization schemes are possible and contemplated within the scope of the present invention.

Tile selection may involve first selecting a particular tile catalog from which to choose a tile, or selecting a particular group of tiles in a tile catalog from which to choose a tile. In one exemplary embodiment, a tile catalog containing photographs representative of the type of region or landscape associated with the source image is selected. In another exemplary method, a tile catalog is selected that contains photographic images from the actual region or landscape where the camouflage is expected to be deployed. In still another embodiment, a group of tiles is selected from one or more tile catalogs based on tile GPS coordinate information, and the proximity of the tile's coordinates to a pre-selected location, such as a known deployment location.

FIG. 1 is a schematic representation of a portion of an arbitrary source image 1 overlaid with a grid 2 of square cells. In one exemplary tile selection method, a first cell 3 of the source image is identified for replacement by a tile selected from the tile catalog 4. The stored color information of the source image cell is then compared to the stored color information for each tile in the selected tile catalog. In one embodiment the comparison is a measure of the straight line color distance between the macro pattern cell and the tile being compared to the macro pattern cell, defined by the following equation:

$$\text{distance}=((Rs-Rt)^2+(Gs-Gt)^2+(Bs-Bt)^2)^{1/2}$$

where Rs, Gs, and Bs are the respective average stored chromaticity values for the selected source image cell; and Rt, Gt, and Bt are the respective average stored chromaticity values for the tile being compared to the source image cell. By going through each tile in the catalog, or selected group of tiles, the difference in color between each tile and the source image cell may be determined. Subject to other selection restrictions described below, the exemplary tile selection method comprises identification of the allowable tile or tiles closest in color to the source image cell.

Figure 2:
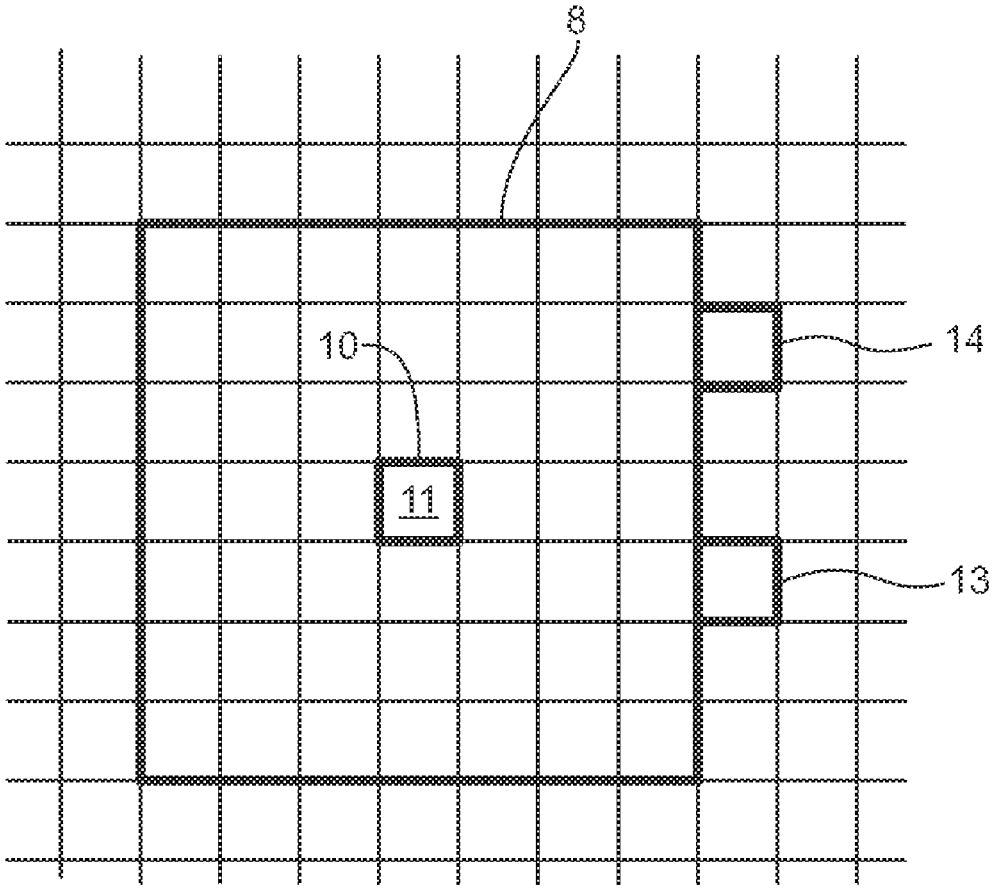
FIG. 2 depicts a neighborhood of cells associated with a central cell.

The tiles from which to choose a closest color match to the source image cell may be restricted to less than all the tiles in the tile catalog by various filtering techniques. In one such technique a neighborhood of cells surrounding the present source image cell is defined, within which any particular tile may be used only once. FIG. 2 depicts such a neighborhood 8 that is centered on a cell 10 containing a tile 11 selected from a tile catalog. Neighborhood 8 is a three cell neighborhood, meaning there must be at least three cells between cell 10 and the next cell containing tile 11, despite tile 11 being potentially the closest in color to a corresponding source cell color. Thus, in accordance with the present embodiment, tile 11 may be used again, subject to other restrictions, at either one of cells 13 and 14. However, despite being more than three cells away from cell 10, there are only two cells between cells 13 and 14. Thus tile 11 may be used in one or the other, but not both of cells 13 and 14, as doing so would violate the three cell neighborhoods around those cells. Within the neighborhood 8, any tile other than tile 11 that is closest in color to a corresponding source image cell color may be selected, subject again to other tile selection restrictions discussed below.

Figure 3:
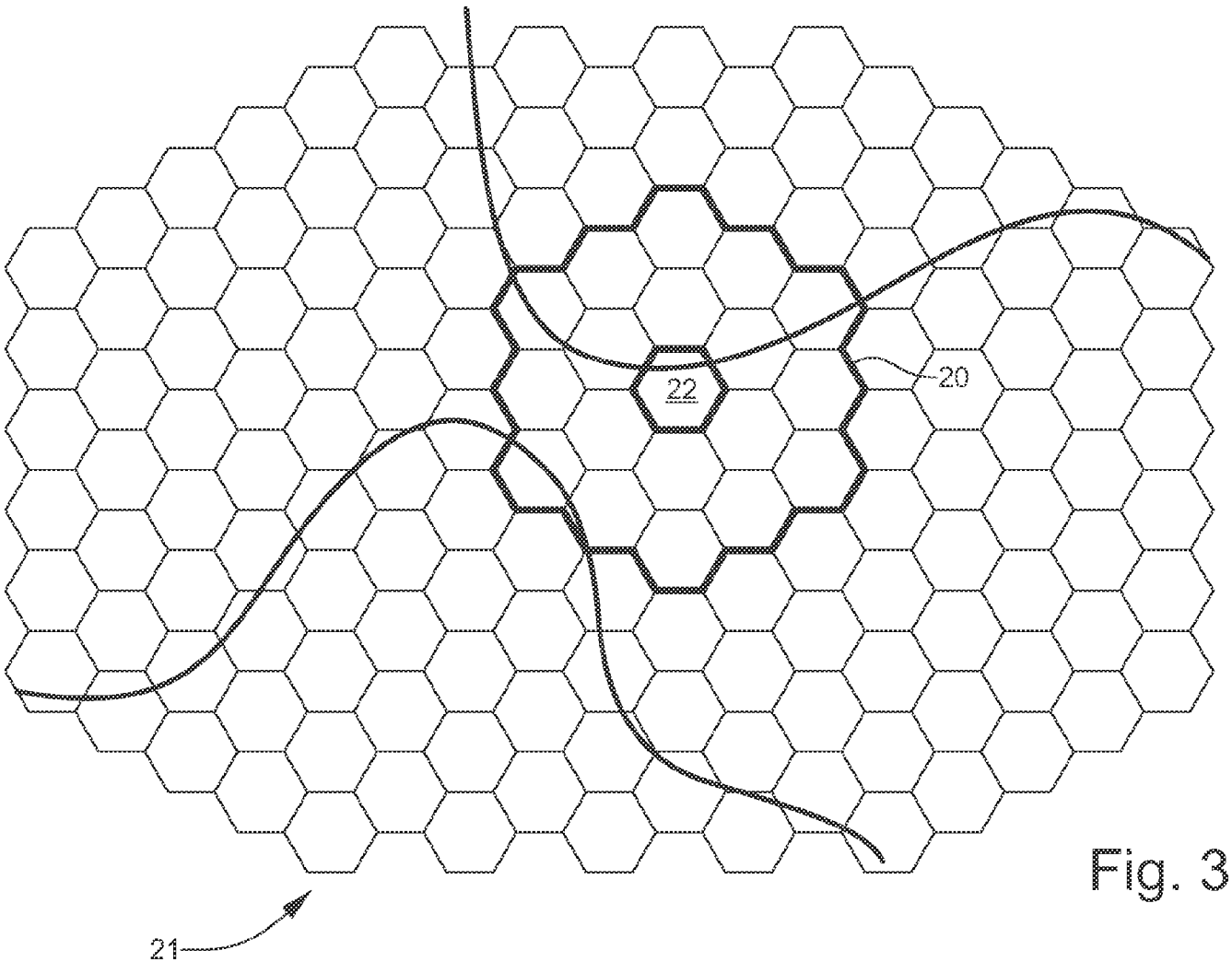
FIG. 3 is a schematic depiction of an average color region associated with a central cell.

In another filtering technique, regions of cells are defined within which the degree of variation in tile colors may be defined. A region may be a matrix of any number of contiguous cells. FIG. 3 is a schematic depiction of a symmetrical region 20 of a hexagonal cell grid applied to a source image 21 and centered about a cell 22. The region 20 is five cells across and contains nineteen cells. A single region color is calculated by averaging the colors of the source image cells within region. The region color may be defined in terms of its RGB chromaticity values. The region filter process requires that the tiles selected for use in the region must average out to the region color. Accordingly, when selecting a tile for cell 22, the region filter process will average the tile color with all eighteen other tiles in the region and compare that color to the average region (source image) color.

Figure 4:
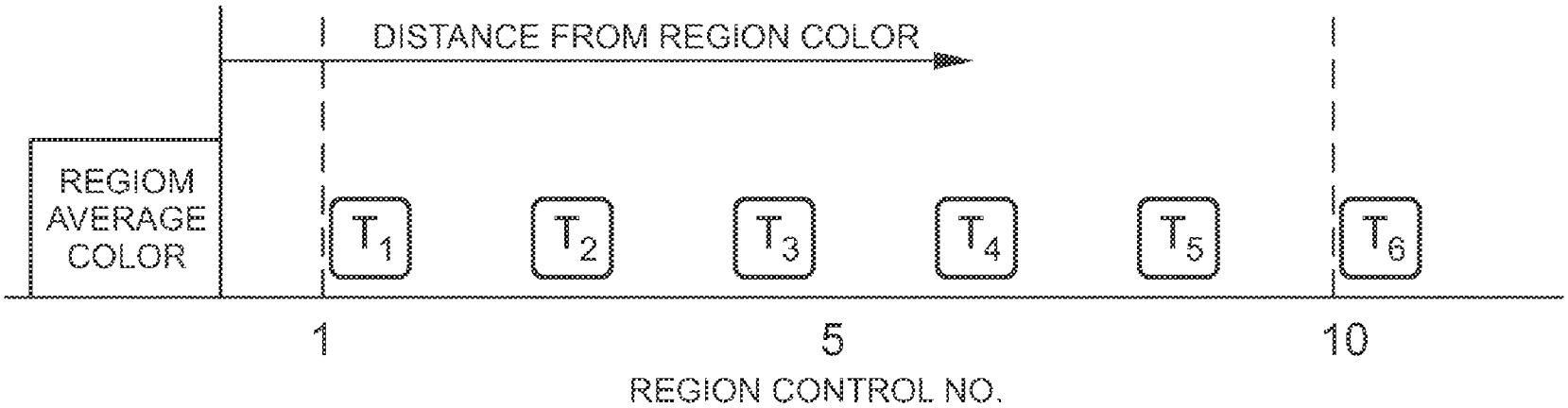
FIG. 4 is a graphical representation of a region control parameter, wherein a catalog of tiles are arranged along a color distance line relative to a region color.

The region filtering technique may further include selection of a region control parameter, such as a number from 1 to 10. The region control parameter determines how different a tile's color must be compared to the average region color in order to be eligible for the use in the region. FIG. 4 is a graphical representation of a control parameter concept in which a catalog of six tiles, labeled T1 through T6, are arranged along a color distance line. The tiles are positioned at their respective color distances from the region average color located at the origin. According to the embodiment of FIG. 4, a region control number of 1 means that none of the six tiles are excluded from selection by the color control, while a region control number of 10 means that tiles T1 through T5 are excluded and only Tile T6 is available for selection, subject to other restrictions and filters. Thus according to the present embodiment, a high control number will cause the region to be populated by tiles that are very color distant from the region color, while a low control number will cause the region to be populated by tiles that are relatively near the region color.

As previously mentioned, all of the tiles used in the region must average to the region color. As a result, a high control number will force selection of tiles with a high degree of color variation in order to average to the region color. Conversely, a very low control number will allow for satisfying the average color requirement with little tile color variation. The region control parameter may thus be used to vary the color complexity of the micro pattern.

In another tile selection filtering technique, a cap is placed on the total number of times that a certain tile, or tile of a certain color may be used in a pattern. For example, in a camouflage pattern for a vehicle destined for a snow covered alpine region, it may be desirable to limit the occurrence of black tiles in the pattern to less than might be allowed by the neighborhood and region filtering processes. In one embodiment of a tile count limit, each tile is checked for compliance before that tile may be used to replace a source image cell. If selection of the tile would exceed the specified limit for that tile, the tile is rejected, and another tile is selected that is as close as possible to the source image cell while complying with all other restrictions and filters.

Once a tile has been selected to replace a source image cell, the color of the tile may be adjusted to any color that lies between the color of the tile and the color of the source cell being replaced. In one embodiment, an adjustment control provides for specifying the selection of any color that lies along a straight line in CIE XYZ color space between the tile and cell colors. Colors along such a straight line comprise all colors that are possible by blending of only the two terminal colors. The control may for example be a percentage number, with zero percent meaning the tile color is not changed, and one hundred percent meaning that the tile color is completely changed to the source image cell color. The opacity adjustment feature commonly found in photographic manipulation software products such as Photoshop® is an example of such a color control that may be adapted to the present embodiment.

The most noticeable effect of the color control will be on the micro appearance of the camouflage pattern. Using the control to force the tiles toward the source image cell colors will have the effect of reducing color variation or complexity in the micro pattern, while small changes from the tiles' original colors will increase color variation and complexity. Color adjustment using a color control may take place after all tiles have been selected, or during the tile selection process.

Figure 5:
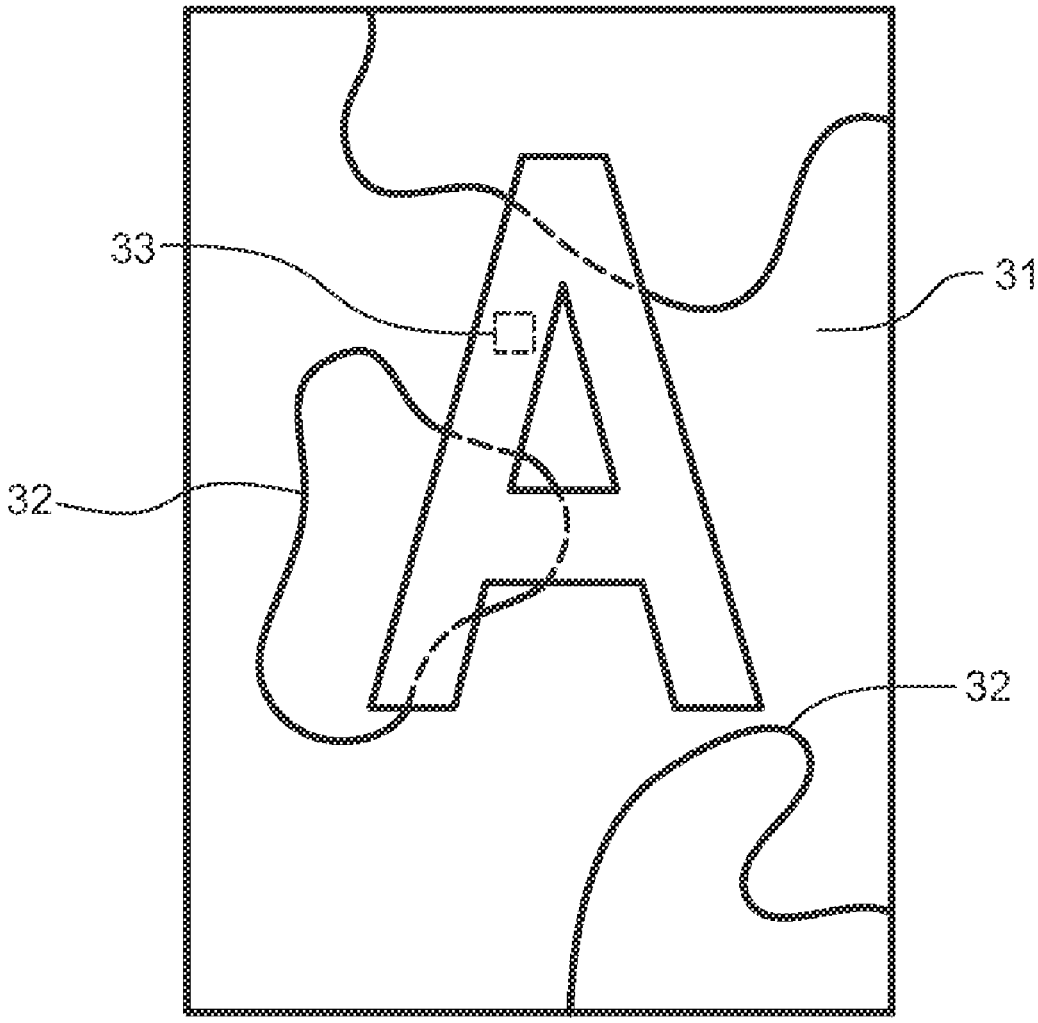
FIG. 5 depicts an exemplary mask applied to a source image.

A macro pattern or source image may be altered by application of a mask. FIG. 5 depicts an exemplary source image 31 containing a pattern 32 of various pre-defined shapes and colors. In accordance with the present embodiment, the source image 31 has been overlaid with a mask in the form of a letter "A". The mask comprises a set of instructions that act to alter the color of cells that fall within the mask boundary while leaving cells outside the mask unaffected. For example, the mask may cause an included cell, such as cell 33, to become darker or lighter by some percentage relative to its original color. Alternatively the mask may force the included cells toward a more uniform luminance value independent of color variations in the underlying source image. Instead of controlling luminance specifically, the mask may also be used to drive the cells toward a specific color such as blue or red. In a computer implemented embodiment the alteration may be accomplished by simply changing the digitally stored chromaticity values for each cell according to the mask instructions.

A mask may be applied at any point of a camouflage generation process. For example, a mask may be applied to a source image prior to selection of tiles. Tile selection may then proceed to populate the masked areas and unmasked areas of the source image according to the same filters and restrictions. Alternatively, a mask may be applied after tiles have been selected, thereby uniformly changing the appearance of the tiles within the mask boundary. More than one mask may be applied as well, for example by applying a first mask, or masks to the source image prior to cell selection, and a second mask, or masks to the tiles after tile selection and cell replacement. Alternatively multiple overlapping masks may be applied before or after cell selection.

Masks may comprise any type of pattern or image, or alternatively various forms of information. For example, in one embodiment a mask comprises an arrangement of lines or squares that represent information in the form of a readable code. The mask may be configured such that the code symbols tend to generally blend in with the underlying micro or macro pattern, yet stand out in relief at some specified long range distance. The symbols may become optically visible at the effective range, or visible only to a specific type of sensing device, such as a scanner adapted for infrared or laser detection. If used on a military uniform for example, the symbols could include information about soldier's identity or military unit. A scanner capable of detecting such a code at long range may be adapted to interpret the code and then display or output the identifying information.

Codes or symbols may also be incorporated at a micro pattern level using a mask. In this embodiment, information in the form of letters, numbers or symbols are applied to specified individual tiles that are identified through a masking process. The markings may again comprise indentifying information about a person or object that is detectable and readable with an appropriate scanning device.

The same techniques described herein for developing a camouflage design that produces dual-range could be further utilized to design a pattern that, in addition to a second, long range pattern, generates and a third, much longer range pattern. In particular, the camouflage pattern could be designed so that the patterns that appear at the second, long range, become tiles or pixels of another much larger tertiary image that becomes discernable at another order of magnitude in distance. Moreover, the technique could be applied any number of times to produce a hierarchy of images, each exponentially larger and more distant than the preceding level.

As a practical matter however, the size of the object being camouflaged and the desired ranges at which concealment is needed may limit the number of levels. For example, if a typical micro pattern tile size on a combat uniform is ½ inch square, the smallest discernable macro pattern may be on the order of 10 inches square, or about twenty times the size of the individual tile. Several 10 inch patterns could realistically fit on a single uniform. However the image associated with a tertiary level would be 20 times the size of the second, macro pattern, or roughly 200 inches. Thus a single image would be larger than the subject being concealed, making a third order of magnitude image probably unrealistic for personnel applications. However, with a smaller micro pattern tile size for a uniform, or for larger subjects such as a building or a ship, third or fourth order images may in fact be practical and useful.

The above described embodiments and elements of a multi-range camouflage and method may comprise a computer executable algorithm embodied in a computer program. A suitable computer program may be adapted to access stored digital image information related to source images and tile catalogs, as well as various input parameters and controls such as mask definitions, region control numbers, and so on. A computer program can be configured to perform any or all of the iterative calculations described herein for selecting tiles and creating a multi-range camouflage. The results may be displayed or stored, and the effect of various combinations of input parameters and control settings may be evaluated by simply re-executing the program.

In one exemplary method of generating a multi-range camouflage, a source image, tile catalog, cell design, and grid configuration are selected or otherwise defined. A mask may also be selected and applied to the source image to alter the coloration or design of the source image in various ways. Tiles may then be selected from the tile catalog and substituted for the cells in the source image.

Selection of tiles according to the exemplary method proceeds on a sequential basis starting with a first cell of the source image. The portion of the source image contained within the first cell is reduced to a single or average color. If a region restriction is defined, the restriction is applied to the selected tile catalog based on the color of the first cell. The region restriction screens out tiles that are too close in color to the first cell color by making them ineligible for selection. The remaining, eligible tiles of the tile catalog are examined for the tile closest in color to the average color of the source image cell being replaced. In one exemplary method the color comparison process comprises determining the straight line color distance between the source cell and the catalog tiles in CIE XYZ color space.

Having located the best match, the tile is checked for eligibility based on any active neighborhood, tile count filters, and the region average color requirement. According to the neighborhood filter, the cell grid is checked for a repeat occurrence of the best match tile within the neighborhood surrounding the cell. The best match tile is also checked against any tile count limits to ensure that selecting the tile will not cause the allowable count to be exceeded. Further, if a region restriction is active, the best match tile combined with all other tiles in the region must average out to the average color of the source image region. If the best match tile violates any of these restrictions or limits, it becomes ineligible, and a next best match tile is located and again checked for compliance.

With a tile selected for substitution in the source cell, the appearance of the cell may be adjusted with the color match control. In one exemplary method the tile is adjusted to any color that lies between the color of the tile and the color of the source cell being replaced. The extent to which the tile color is changed may be defined with a color match control parameter in the form of a number or percentage. With the first cell defined, a second cell of the source grid may be selected for substitution with a tile from the tile catalog, proceeding with the same method elements used to select the first tile. The procedure is repeated until all cells in the source image have been replaced.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A method of creating a multi-range camouflage pattern, comprising:

defining a source image as a basis for a long range camouflage pattern;

dividing the source image into an array of cells, each cell containing a portion of the source image;

substituting tiles selected from a tile catalog for each cell of the array; and forcing a predetermined minimum color variation between neighboring cells such that at close range, variations in tile color dominate to produce a micro camouflage pattern, and at long range, the source image dominates to produce a macro camouflage pattern.

2. The method of claim 1, wherein the tiles selected from the tile catalog comprise photographic images.

3. The method of claim 2, wherein tiles are selected based on an average color of the photographic image.

4. The method of claim 3, wherein the action of substituting tiles selected from a tile catalog comprises:

determining an average color of a first cell of the source image;

selecting a tile from a group of eligible tiles in the tile catalog that is closest in average color to the average color of the first cell of the source image; and replacing the first cell of the source image with the selected tile.

5. The method of claim 2, further comprising storing information about each photographic image, the information selected from the group comprising the date, time, and location at which the photograph was taken.

6. The method of claim 5, wherein the information about the location where the photograph was taken comprises a geographic position in terms of latitude and longitude.

7. The method of claim 1, wherein forcing a minimum color variation between neighboring cells comprises:

defining a region of cells surrounding a first cell of the source image;

determining a color distance between the first cell of the source image and individual tiles in the tile catalog, and eliminating from eligibility for the region any tiles that are less than a predefined color distance from the first cell; and replacing a cell in the region with an eligible tile selected from the tile catalog.

8. The method of claim 7, further comprising:

calculating a region color by averaging the color of the source image cells within the region;

requiring that the tiles selected to replace the cells in the region average as a group to the average color of the region.

9. The method of claim 7, further comprising adjusting the color of a selected tile to a color that lies between the color of the selected tile and the color of the first cell of the source image.

10. The method of claim 1, further comprising capping the number of times any one tile may be used in the array.

11. The method of claim 1, wherein the cells are elongated in a direction corresponding to a directional quality of the source image.

12. A method of creating a multi-range camouflage pattern, comprising:

identifying a source image as a basis for a macro camouflage pattern;

dividing the source image into an array of cells, each cell containing a portion of the source image;

determining an average color of a first cell of the source image;

defining a tile color variation parameter that forces a predetermined minimum color variation between neighboring cells;

selecting from a group of tiles one tile that is closest in average color to the average color of the first cell of the source image, and that satisfies the tile color variation parameter;

replacing the first cell of the source image with the selected tile; and repeating the identifying, dividing, determining, defining, selecting, and replacing actions for each cell of the array.

13. The method of claim 12, wherein the group of tiles comprises a catalog of photographic images.

14. The method of claim 13, further comprising determining one average color for each photographic image.

15. The method of claim 14, wherein the photographs in the catalog correspond to a geographic location.

16. The method of claim 14, further comprising:

storing with each photograph the latitude and longitude at the location where the photograph was taken; and populating the tile catalog based on proximity of the location where the photograph was taken to a selected geographic location.

17. The method of claim 16, wherein the multi-range camouflage is intended for use at the selected geographic location.

* * * * *